US008888074B2

(12) United States Patent
Amano et al.

(10) Patent No.: US 8,888,074 B2
(45) Date of Patent: Nov. 18, 2014

(54) MEMBRANE FOR AIR DIFFUSER

(71) Applicant: UWM Research Foundation, Inc., Milwaukee, WI (US)

(72) Inventors: Ryoichi Samuel Amano, Milwaukee, WI (US); Ammar Alkhalidi, Milwaukee, WI (US)

(73) Assignee: UWM Research Foundation, Inc., Milwaukee, WI (US)

( * ) Notice: Subject to any disclaimer, the term of this patent is extended or adjusted under 35 U.S.C. 154(b) by 246 days.

(21) Appl. No.: 13/654,977

(22) Filed: Oct. 18, 2012

(65) Prior Publication Data

US 2013/0099401 A1 Apr. 25, 2013

Related U.S. Application Data

(60) Provisional application No. 61/549,552, filed on Oct. 20, 2011, provisional application No. 61/557,188, filed on Nov. 8, 2011.

(51) Int. Cl.
*B01F 3/04* (2006.01)

(52) U.S. Cl.
CPC ... *B01F 3/04269* (2013.01); *B01F 2003/04312* (2013.01); *B01F 2003/04361* (2013.01); *B01F 2003/04368* (2013.01)
USPC ..... 261/77; 261/121.1

(58) Field of Classification Search
USPC ..... 261/76, 77, 119.1, 121.1; 366/101, 106
See application file for complete search history.

(56) References Cited

FOREIGN PATENT DOCUMENTS

JP 05137988 A * 6/1993 ..... 422/243

OTHER PUBLICATIONS

Andras, H. et al. "CFD simulation of bubble columns using the VOF model: comparison of commercial and open source sovers with an experiment,"Chemical Engineering Transations (2009) vol. 18.
Asgharpour, M. et al. "Effect of surface contaminants on oxygen transfer in bubble column reactors," Biochemical Engineering Journal (2010) 49:351-360.
Colombet, D. et al. "Experimental study of mass transfer in a dense bubble swarm," Chemical Engineering Science (2011) 66:3432-3440.
Dani, A. et al. "Local measurement of oxygen transfer around a single bubble by planar laser-induced fluorescence," Chemical Engineering Science (2007) 62:7245-7252.
Gnyloskurenko, S.V. et al. "Influence of wetting conditions on bubbles formation at orifice in an inviscid liquid. Transformation of bubble shape and size," Colloids and Surfaces A: Physicochem. Eng. Aspects (2003) 218:73-87.
Gourich, B. et al. "Influence of hydrodynamics and probe response on oxygen mass transfer measurements in a high aspect ratio bubble column reactor: Effect of the coalescence behaviour of the liquid phase," Biochemical Engineering Journal (2008) 39:1-14.
Kawamura, T. et al. "The effects of the bubble size on the bubble dispersion and skin friction reduction," National Maritime Research Institute (2003) Japan.

(Continued)

*Primary Examiner* — Robert A Hopkins
(74) *Attorney, Agent, or Firm* — Michael Best & Friedrich LLP

(57) ABSTRACT

A membrane for use in an air diffuser. The membrane includes a nub with a perforation. The nub and perforation and arranged and sized to create smaller bubbles of gas in a liquid column above the membrane.

15 Claims, 5 Drawing Sheets

(56) References Cited

OTHER PUBLICATIONS

Krishna, R. et al. "Improving gas-liquid mass transfer in bubble columns by applying low-frequency vibrations," Chem. Eng. Technol. 25 (2002).
Lauterborn, W. et al. "Cavitation bubble dynamics," Elsevier Sciences B.V., Ultrasonice sonochemistry 4 (1997) 65-75.
Levitsky, S. et al. "Water Oxygenation in an experimental aerator with different air/water interaction patterns," HAIT Journal of Science and Engineering B, (2005) vol. 2, Issue 1-2:242-253.
Li, E.et al. "Air—water ratio as a characteristic criterion for fine bubble diffused aeration systems," Chemical Engineering Journal (2008) 137:214-224.
Mart'in, M. et al. "Oxygen transfer from growing bubbles: Effect of the physical properties of the liquid," Chemical Engineering Journal (2007) 128:21-32.
Mineta, R. et al. (2011) "Oxygen transfer during aerobic biodegradation of pollutants in a dense activated sludge slurry bubble column: Actual volumetric oxygen transfer coefficient and oxygen uptake rate in p-nitrophenol degradation by acclimated waste activated sludge," Biochemical Engineering Journal (2011) 53:266-274.
Park, J. "Computational fluid dynamics simulation and experimentation of bubbly twophase flow in horizontal configuration," PhD thesis University of Wisconsin Milwaukee (2007).
Schierholz, E. et al. "Gas transfer from airdiffusers," Water Research (2006) 40:1018-1026.
Solomon, C. et al. Fact sheet. Developed by the National Small Flows Clearinghouse (1998).
Sotiriadis, A. et al. "Bubble size and mass transfer characteristics of sparged downwards two-phase flow," Chemical Engineering Science (2005) 60:5917-5929.
Sussman, M. "A second order coupled level set and volume-of-fluid method for computing growth and collapse of vapor bubbles," Elsevier Science B.V. Journal of Computational Physics (2003) 187:110-136.

* cited by examiner

MEMBRANE FOR AIR DIFFUSER

BACKGROUND

The present invention relates to a membrane for use in an air diffuser. The membrane includes a nub with a perforation. The nub and perforation are arranged and sized to create small bubbles of gas in a liquid column above the membrane.

SUMMARY

The invention provides an apparatus for producing fine bubbles of a gas in a liquid, the apparatus comprising: a membrane that is not permeable to gas, the membrane including first and second opposite surfaces, the first surface being exposed to the gas and the second surface being exposed to the liquid; a raised nub on the second surface of the membrane, the nub including a base that is proximal the second surface and a tip that is distal with respect to the second surface, the base having a base width and the tip width having a tip width smaller than the base width, the nub having a nub height measured from the base to the tip, the nub including a perforation placing the gas in communication with the liquid through the nub; wherein the ratio of nub height to tip width is in the range 0.5-100; wherein gas flowing through the perforation forms a bubble in the liquid.

The tip width may be in the range 0.5 μm-12 mm. The ratio of nub height to base width may be in the range 0.5-100. The nub may have a trapezoidal cross-section, a triangular cross-section, a rectangular cross-section, or a semi-circular cross-section. The base of the nub may have a polygonal cross-section or a circular cross-section. The membrane may be constructed of a material selected from the group consisting of at least one of polymers, metals, and composite material. The tip may be rounded or may include a sharp edge. The nub may include a plurality of perforations. The membrane may be a disc membrane or a tube membrane. The nub may include a plurality of concentric sharp nubs formed in a ring. Each nub may include a plurality of perforations in the shape of slits. The nub may include a plurality of nubs each including a single perforation.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
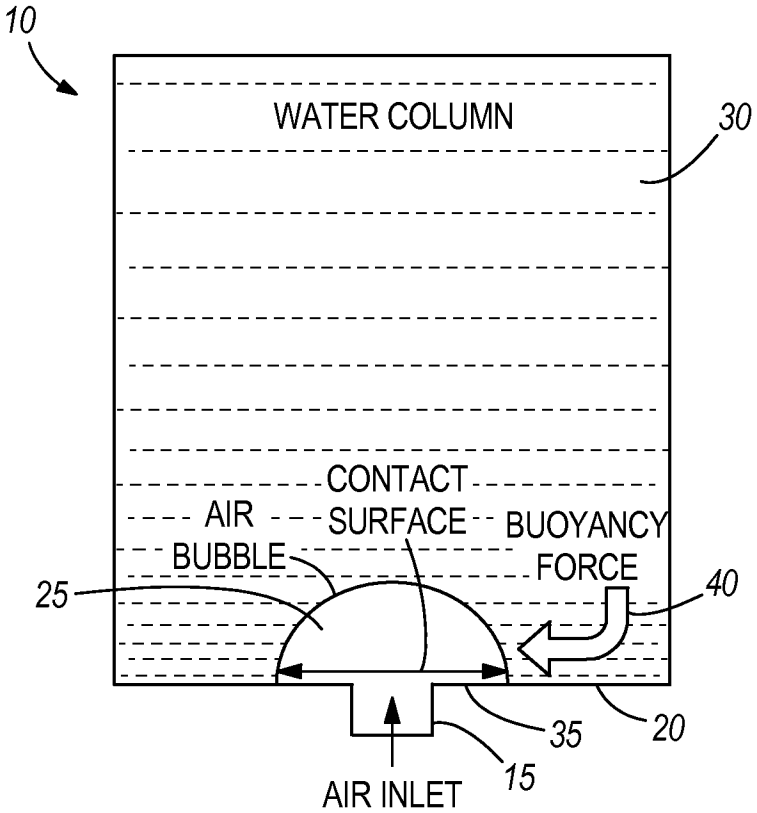
FIG. 1 PRIOR ART
FIG. 1 illustrates a prior art bubble formation system.

FIG. 1 illustrates a known, prior art air diffuser arrangement 10 in which a simple hole 15 or other aperture is formed in a membrane 20. The hole 15 can be referred to generally as a perforation or an air inlet. As air flows through the air inlet 15, a bubble 25 forms in the water column 30. The bubble 25 expands along the surface of the membrane 20 that faces the water column 30. The portion of the membrane 20 in contact with the bubble 25 as the bubble forms and expands can be referred to as the contact surface 35. As illustrated with an arrow 40 in FIG. 1, the buoyancy forces in water column 30 acting on the bubble 25 create a horizontal line of force on the bubble 25. Eventually, the bubble 25 reaches a size (e.g., a diameter) at which it takes balloon shape under buoyancy forces 40 effect that eventually will peel the edges of the bubble 25 up off the contact surface 35, the edges of the bubble 25 are separated from the membrane 20, the bubble 25 fully detaches from the membrane 20, and floats up the water column 30.

Figure 2:
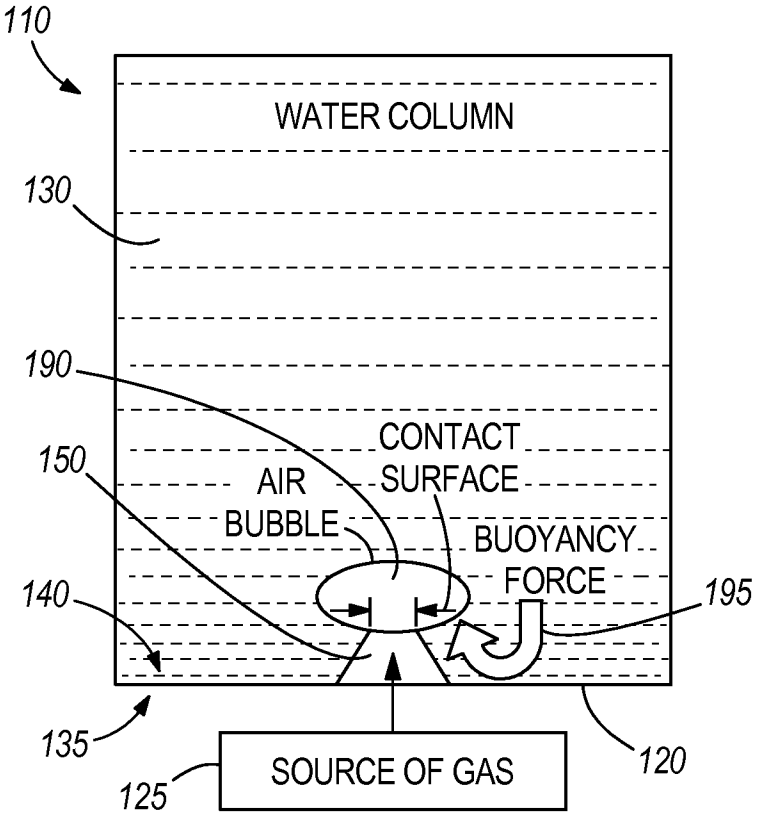
FIG. 2 illustrates a bubble formation system according to the present invention.

FIG. 2 illustrates an air diffuser apparatus 110 for producing fine bubbles of a gas in a liquid according to the present invention. The apparatus 110 includes a membrane 120, a gas inlet 125 communicating with a source of gas (e.g., an air pump), and a liquid (e.g., water or a water column) 130. The membrane 120 is not permeable to gas, and includes first and second opposite surfaces 135, 140. The first surface 135 faces or is exposed to the supply of a gas 125 and the second surface 140 faces or is exposed to the liquid 130. A raised nub 150 is formed in the membrane 120. The raised nub 150 can be formed by punching a hole or slot (broadly, a "perforation") in the membrane 120 from the first surface 135 through to the second surface 140. Gas pressure causes the membrane 120 to bulge in the direction of the second surface 140. The bulging action opens the punch to allow gas to go through the membrane. When the gas pressure is turned down, the membrane returns to the at-rest condition in which all punches are closed and water is prevented from going through membrane from the second surface 140 to the first surface 135.

Figure 3A:
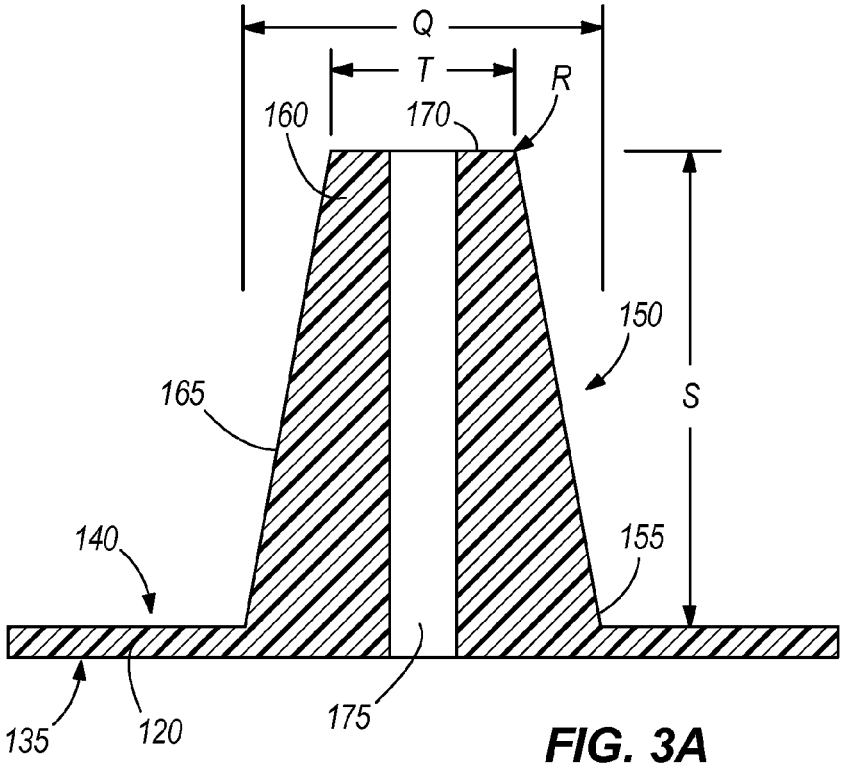
FIG. 3A is a cross-section view of a nub with a straight perforation.
Figure 3B:
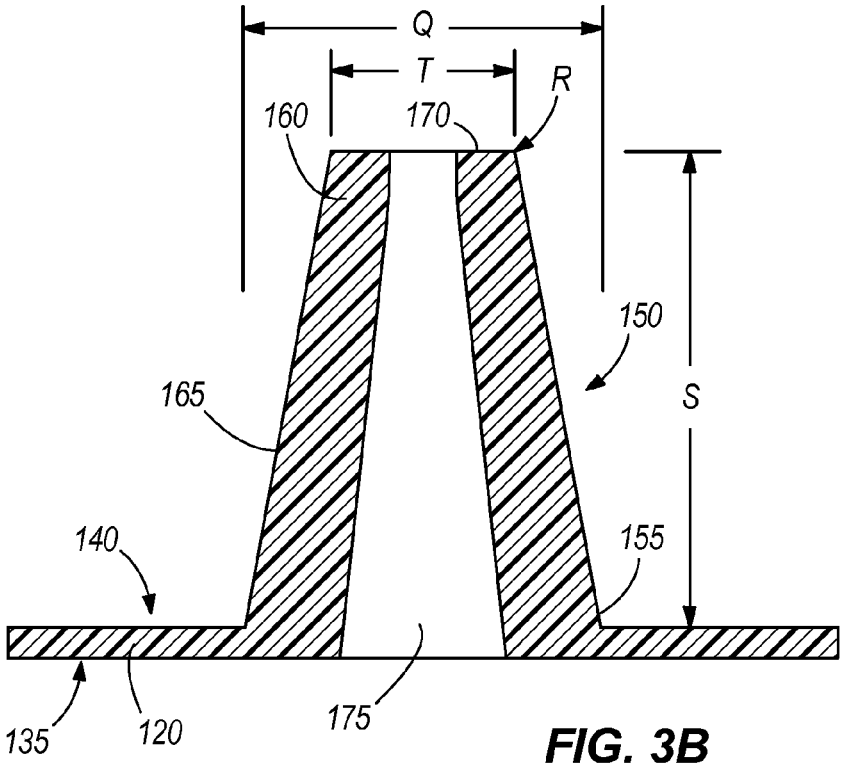
FIG. 3B is a cross-section view of a nub with a tapered perforation.
Figure 3C:
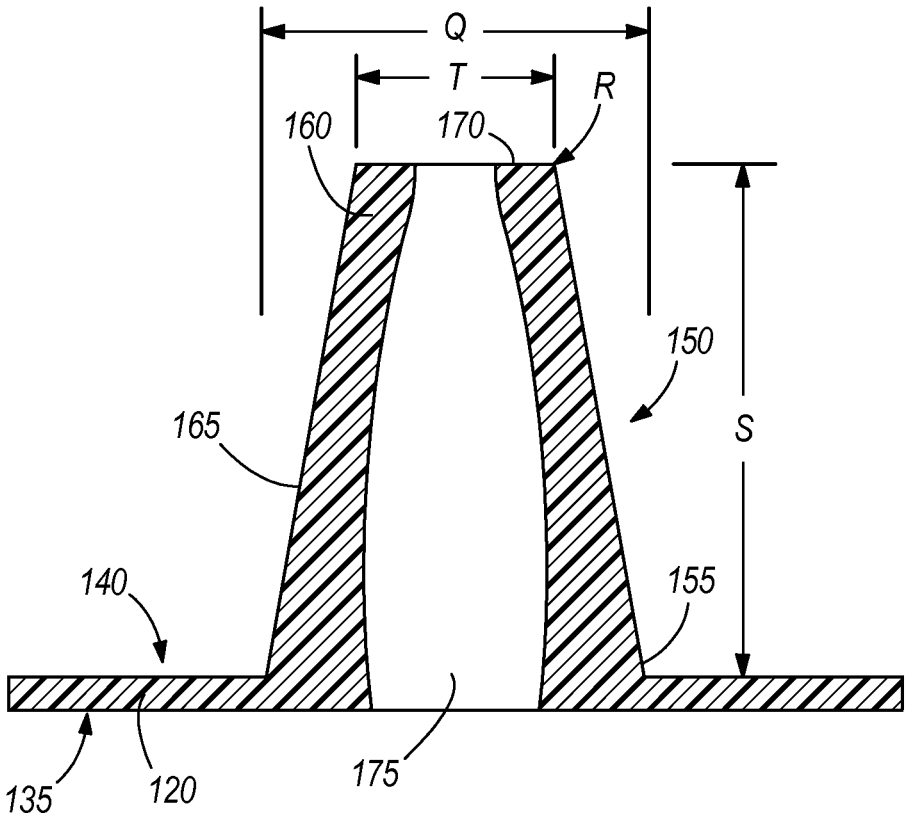
FIG. 3C is a cross-section view of a nub with a rounded perforation.

Referring now to FIGS. 3A, 3B, and 3C, the nub 150 includes a base 155 that is proximal the second surface 140 and a tip 160 that is distal with respect to the second surface 140. A side surface 165 extends from the base 155 to the tip 160. For the purposes of this disclosure, the side surface 165 of the nub 150 will be deemed separate from the second surface 140 of the membrane 120, even though it is acknowledged that the side surface 165 of the nub 150 is formed from bulging the second surface 140. References to the second surface 140 of the membrane 120 will include the portions of the membrane 120 that surround the base 155 of the nub 150, but shall not include the side surface 165 of the nub 150.

The base 155 has a base width Q. The tip 160 includes a tip surface 170 that has a tip width T. The tip width T is smaller than the base width Q. The nub 150 has a nub height S measured from the base 155 to the tip 160. A perforation 175 in the nub 150 places the gas inlet 125 in communication with the liquid 130 through the nub 150. The perforation 175 may be straight (FIG. 3A), tapered (FIG. 3B), rounded (FIG. 3C), or any other shape.

Figure 4:
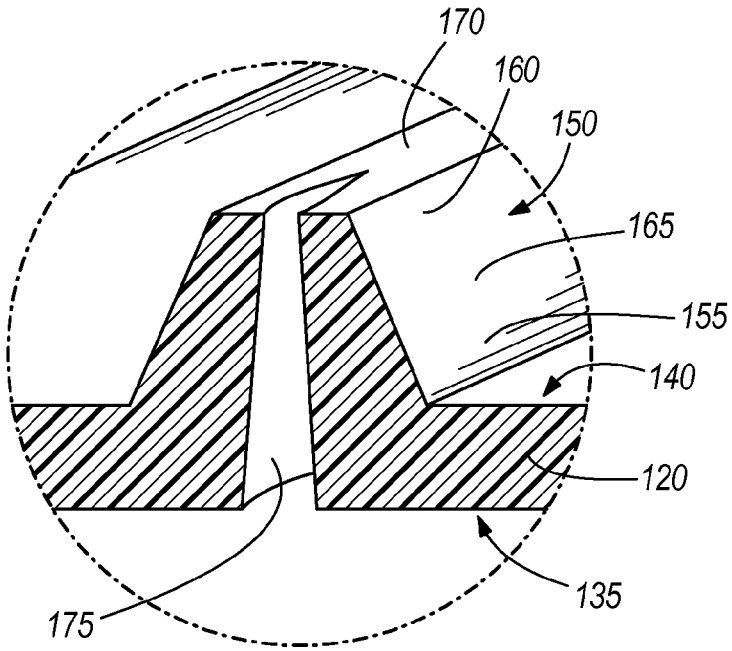
FIG. 4 is a cross-section of a nub having a sharp edge.
Figure 5:
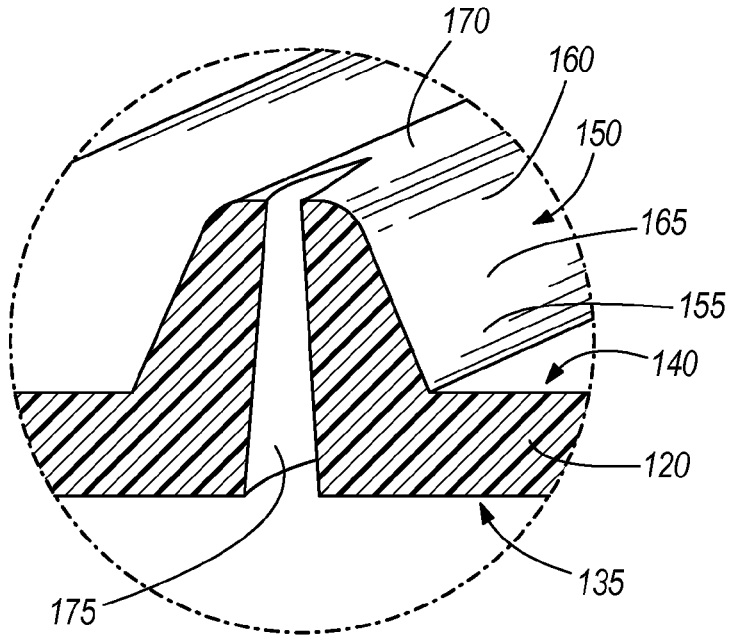
FIG. 5 is a cross-section of a nub having a rounded edge.

The transition from the tip surface 170 to the side surface 165 includes a radius of curvature R. If the radius of curvature R is relatively small, the tip 160 may be referred to as "sharp" (i.e., define a sharp edge) as illustrated in FIG. 4. If the radius of curvature R is relatively large as illustrated in FIG. 5, the nub 150 may be said to have a rounded edge between the tip surface 170 and side surface 165.

Referring again to FIG. 2, the gas flows through the perforation 175 and into the liquid 130, where the gas forms a bubble 190 on the tip 160 of the nub 150. The bubble 190 expands along the tip surface 170, and in this regard the tip surface 170 can also be referred to as the contact surface. The buoyancy force 195 of the water 130 on the forming bubble 190 acts upwardly along the nub 150, and is therefore not horizontal as in the known arrangement in FIG. 1.

Because there is an upward component to the buoyancy force, and also because the bubble 190 quickly extends over the edge of the contact surface 170 because of the relatively small tip surface area, the outer edges of the forming bubble 190 are lifted by the buoyancy force 195. Consequently, the bubble 190 is completed and lifted off the contact surface 170 more rapidly than in the known arrangement in FIG. 1, and a smaller bubble 190 is formed.

The geometry of the nub 150 changes the buoyancy force 195 line of action from horizontal to an upward line of action, allowing smaller bubbles to separate from the membrane 120. The invention enables aeration of liquids by pumping gas through a diffuser membrane with a geometry that allows bubbles formed in the liquid to cleave from the diffuser membrane with less gas in the bubble resulting in fine bubble formation.

The nub 150 may have a cross-section that is trapezoidal, but a trapezoidal cross-section is not required. The nub 150 can take any number of forms, including without limitation: conical, pyramidal, hemispherical, and an extruded star. The nub 150 may have a horizontal cross-section or base that is triangular, rectangular, circular, semi-circular, or polygonal (e.g., star-shaped), for example and without limitation.

The nub 150 will form fine bubbles if the tip width T is sufficiently small and the width-to-height ratio (T/S) is small enough so the bubble 190 does not attach to the second surface 140 as the bubble forms. In one embodiment, the tip width T is in the range 0.5 μm-12 mm. The ratio of nub height to tip width (S/T) is preferably in the range 0.5-100. The ratio of nub height to base width (S/Q) is preferably in the range 01~100. The ratio of nub height to radius of curvature (S/R) is preferably within the range 01~100.

The membrane 120 may be constructed of any of the following materials, for example and without limitation: polymers, metals, and composite material. The membrane 120 may be made of combinations of these materials as well. The membrane 120 may be a disc membrane, a tube membrane, or a rectangular, conical, or trapezoidal membrane depending on the intended environment and application.

Figure 6:
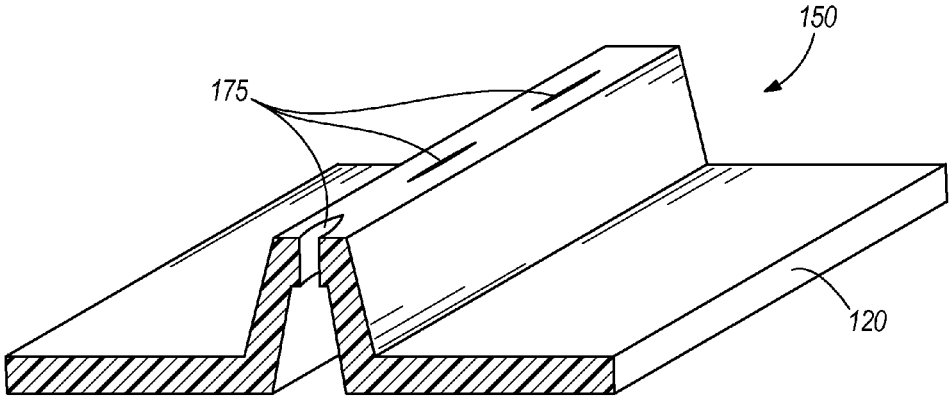
FIG. 6 is a perspective view of an elongated nub having a plurality of slit-shaped perforations.

FIG. 6 illustrates an elongated nub 150 that includes a plurality of perforations 175. Other arrangements may have a nub 150 that is enlarged in another way, other than merely elongated. The nub 150 may include a plurality of perforations 175.

Figure 7:
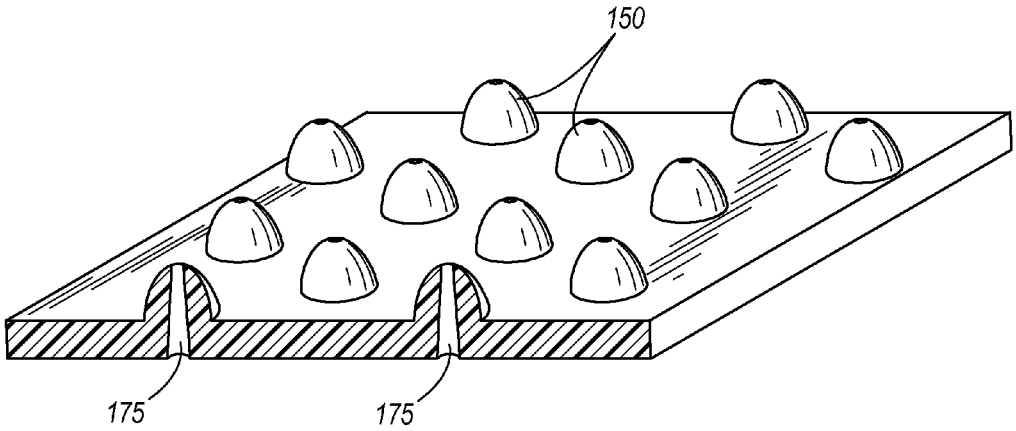
FIG. 7 is a perspective view of a plurality of semi-spherical nubs.

FIG. 7 illustrates an arrangement of nubs 150. Each nub 150 may include a single perforation 175, but it may in other arrangements include a plurality of perforations. The perforations 175 are illustrated as being circular, but may be in the shape of slits in other arrangements. The illustrated nubs 150 are hemi-spherical or frusto-spherical. The nubs 150 can be arranged in a circular pattern in alternative embodiments.

Thus, the invention provides, among other things, a membrane with a nub arranged to generate small bubbles. Various features and advantages of the invention are set forth in the following claims.

What is claimed is:

1. An apparatus for producing fine bubbles of a gas in a liquid, the apparatus comprising:

a membrane that is not permeable to gas, the membrane including first and second opposite surfaces, the first surface being exposed to the gas and the second surface being exposed to the liquid;

a raised nub on the second surface of the membrane, the nub including a base that is proximal the second surface and a tip that is distal with respect to the second surface, the base having a base width and the tip width having a tip width smaller than the base width, the nub having a nub height measured from the base to the tip, the nub including a perforation placing the gas in communication with the liquid through the nub;

wherein the ratio of nub height to tip width is in the range 0.5-100;

wherein gas flowing through the perforation forms a bubble in the liquid; and wherein the nub has a cross-section selected from the group consisting of trapezoidal, triangular, rectangular, and semi-circular.

2. The apparatus of claim 1, wherein the tip width is in the range 0.5 μm-12 mm.

3. The apparatus of claim 1, wherein the ratio of nub height to base width is in the range 0.5-100.

4. The apparatus of claim 1, wherein the base of the nub has a polygonal cross-section.

5. The apparatus of claim 1, wherein the base of the nub has a circular cross-section.

6. An apparatus for producing fine bubbles of a gas in a liquid, the apparatus comprising:

a membrane that is not permeable to gas, the membrane including first and second opposite surfaces, the first surface being exposed to the gas and the second surface being exposed to the liquid;

a raised nub on the second surface of the membrane, the nub including a base that is proximal the second surface and a tip that is distal with respect to the second surface, the base having a base width and the tip width having a tip width smaller than the base width, the nub having a nub height measured from the base to the tip, the nub including a plurality of perforations placing the gas in communication with the liquid through the nub;

wherein the ratio of nub height to tip width is in the range 0.5-100; and wherein gas flowing through the perforation forms a bubble in the liquid.

7. The apparatus of claim 6, wherein the tip width is in the range 0.5 μm-12mm.

8. The apparatus of claim 6, wherein the ratio of nub height to base width is in the range 0.5-100.

9. The apparatus of claim 6, wherein the base of the nub has a polygonal cross-section.

10. The apparatus of claim 6, wherein the base of the nub has a circular cross-section.

11. An apparatus for producing fine bubbles of a gas in a liquid, the apparatus comprising:

a membrane that is not permeable to gas, the membrane including first and second opposite surfaces, the first surface being exposed to the gas and the second surface being exposed to the liquid;

a plurality of raised nubs on the second surface of the membrane, each nub including a base that is proximal the second surface and a tip that is distal with respect to the second surface, the base having a base width and the tip width having a tip width smaller than the base width, each nub having a nub height measured from the base to the tip, each nub including a single perforation placing the gas in communication with the liquid through the nub;

wherein the ratio of nub height to tip width for each nub is in the range 0.5-100; and wherein gas flowing through the perforation of each nub forms a bubble in the liquid.

12. The apparatus of claim 11, wherein the tip width is in the range 0.5 μm-12mm.

13. The apparatus of claim 11, wherein the ratio of nub height to base width is in the range 0.5-100.

14. The apparatus of claim 11, wherein the base of each nub has a polygonal cross-section.

15. The apparatus of claim 11, wherein the base of each nub has a circular cross-section.

* * * * *